US006912953B2

(12) United States Patent
Hauer

(10) Patent No.: US 6,912,953 B2
(45) Date of Patent: Jul. 5, 2005

(54) ROLLER

(75) Inventor: Horst-Walter Hauer, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/486,917

(22) PCT Filed: Aug. 28, 2002

(86) PCT No.: PCT/DE02/03141

§ 371 (c)(1),
(2), (4) Date: Feb. 24, 2004

(87) PCT Pub. No.: WO03/024717

PCT Pub. Date: Mar. 27, 2003

(65) Prior Publication Data

US 2004/0231538 A1 Nov. 25, 2004

(30) Foreign Application Priority Data

Aug. 29, 2001 (DE) ..... 101 42 226

(51) Int. Cl.[7] ..... B41F 1/46
(52) U.S. Cl. ..... 101/348; 101/351.2; 101/352.03
(58) Field of Search ..... 101/348, 351.2, 101/352.03

(56) References Cited

U.S. PATENT DOCUMENTS 3,622,059 A 11/1971 Savela
4,486,258 A * 12/1984 Schrotz et al. ..... 156/384
4,756,249 A * 7/1988 Hardin ..... 101/348
4,756,634 A * 7/1988 Henriksson ..... 400/207
5,119,726 A 6/1992 Dorsam
5,351,614 A * 10/1994 Depa ..... 101/148

FOREIGN PATENT DOCUMENTS

| | | | | |
|---|---|---|---|---|
| DE | 483 217 | | 9/1929 | |
| DE | 1 561 014 | B1 | 2/1970 | |
| DE | 1 561 014 | C1 | 2/1970 | |
| DE | 2 038 799 | | 7/1971 | |
| DE | 3110497 | A1 * | 6/1980 | ..... B41F/7/26 |
| DE | 39 31 291 | C1 | 4/1991 | |
| DE | 199 61 190 | A1 | 6/2001 | |
| EP | 0 941 849 | A1 | 9/1999 | |
| GB | 1 213 903 | | 11/1970 | |
| GB | 2 358 893 | A | 8/2001 | |
| JP | 10286942 | A * | 10/1998 | ..... B41F/21/05 |

* cited by examiner

*Primary Examiner*—Andrew H. Hirshfeld
*Assistant Examiner*—Andrea H. Evans
(74) *Attorney, Agent, or Firm*—Jones Tullar & Cooper PC

(57) ABSTRACT

A roller machine includes a rotatably mounted roller body which can be placed on or against one counter roller. The roller has at least one axis and at least one spring element which is arranged between the roller body and a machine frame. The spring element is disposed between the roller body and the part of the axis which is used to secure the roller.

23 Claims, 3 Drawing Sheets

ROLLER

FIELD OF THE INVENTION

The present invention is directed to a roller for a printing press. The roller includes a rotatably supported roller body.

BACKGROUND OF THE INVENTION

A roller is known from EP 0 941 849 A1. Shaft sections of the roller described in that document project from each of the roller end faces and are rotatably seated in bearing shells. The bearing shells are connected with the press frame by spring elements, so that when the roller is placed against a counter-pressure roller, the roller body can yield radially. Because of this resilient seating of the roller, size deviations, for example as a result of increased wear, can be compensated for. It is furthermore possible to provide defined contact pressures between the roller and counter-pressure roller in a simple way because of the resilient seating.

U.S. Pat. No. 4,756,249 A describes an inking roller, whose shell tube is seated, resilient in the radial direction, on its shaft.

DE-PS 15 61 014 shows an inking roller whose shaft is received in a resilient bearing.

SUMMARY OF THE INVENTION

The object of the present invention is directed to providing a roller.

This object is attained in accordance with the present invention by providing the roller with a rotatably supported roller body. The roller has at least one shaft. At least one spring element is arranged between the roller body and the frame of the printing press which supports the roller. The spring element may be in the shaft. It may have a rotationally symmetrical cross-section. Alternatively, the spring element cross-section may not be rotationally symmetrical but may instead be shaped in accordance with a predetermined directionally-dependent spring characteristic. The shaft of the roller may be at least partially in the form of a bar spring.

The spring element of the roller in accordance with the present invention is arranged between the roller body of the roller and the part of the shaft used for fastening the roller. A special advantage of the present invention lies in that particularly compact structures are possible because of the arrangement of the spring element between the roller body and the shaft. It is moreover possible to retrofit rollers of existing printing presses, which are not resiliently seated, to be able in this way, to achieve the desired resilient effect without requiring extensive corrective structural measures.

The structural embodiment of the shaft itself, for use in providing the arrangement of the spring element between the roller body and the shaft, can basically be arbitrary. It is thus conceivable, for example, to embody the shaft essentially in one piece, so that it extends from one roller end face to the other roller end face in the interior of the roller body. In connection with longer rollers, it is particularly advantageous if the roller body is seated on two separate shafts, each of which shafts is arranged in the area of a roller end face.

The structural embodiment of the spring elements can basically be arbitrary. It is, for example, conceivable to arrange spring-seated bearing shells between the shaft and the roller body, so that the roller body can be displaced against a spring force in a radial direction in relation to the shaft. If the shaft itself is embodied as a spring element, this constitutes a particularly simple and cost-effective option for providing the structural principle of the present invention. In other words, this means that, because of its embodiment, the shaft permits an at least small elastic deformation, so that the roller body can be displaced in relation to the clamping of the shaft opposite to the required resilient restoring force required for the deformation of the shaft.

In accordance with a preferred embodiment of the present invention, the shaft is configured in the manner of a bar spring element. Based on the bar shape of the shaft, it is possible to deform the shaft transversely in relation to is longitudinal axis, so that, in this way, it makes the spring effect possible.

If the bar spring element, which is used as the shaft, has a rotationally symmetrical cross section, it is possible, because of this, to achieve that the spring characteristic of the bar spring element is substantially identical in all radial directions.

If the bar spring element has a cross section which is not rotationally symmetrical, it becomes possible, because of an appropriate selection of the cross section, or of a suitable arrangement of the cross section following the mounting of the shaft, to set a predetermined, and in particular a directionally dependent, spring characteristic.

This is of particular advantage if the roller is intended to be simultaneously placed against several counter-pressure rollers. By an appropriate selection of the cross section of the shaft, or of its arrangement following the installation of the roller, it is possible to set different spring characteristics with respect to the various counter-pressure rollers. It then follows that if, for example, a shaft with a rectangular cross section is selected, the bar spring element has a considerably steeper characteristic spring curve, with respect to deformations in one direction, namely in a direction of the greatest width of the bar spring element, than in a direction extending perpendicularly thereto, namely in the direction along the shortest width of the bar spring element.

If the cross section, or the arrangement of the cross section of the bar spring element, is suitably selected, it is possible to mount the bar spring element with a prestress which is a function of the direction. In this way, the reaction forces caused by the weight of the roller, which act with different force on the various counter-pressure rollers, are compensated. As a result, it is possible that the same reaction forces will act on all counter-pressure rollers which are placed against the roller, independently of their installed position in relation to the vertical direction. The weight of the roller no longer has a substantial effect on the contact pressure between the roller and the various counter-pressure rollers.

In some applications, for example if the roller is embodied as an application roller, which is simultaneously placed against a forme cylinder and a distribution cylinder, it is necessary that the bar spring element is not substantially resiliently compressed in at least one direction.

In order to be able to assure sufficient dynamic stability in all operational situations, in spite of the resilient seating of the roller body on the shaft, in some applications it is desirable for a damping element to be arranged between the shaft and the roller body. By the use of this damping element, it is possible to damp out an excitation of the roller, in particular within the range of the roller's resonance frequencies, to such a degree that the roller body remains in a dynamically stable state at all times.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
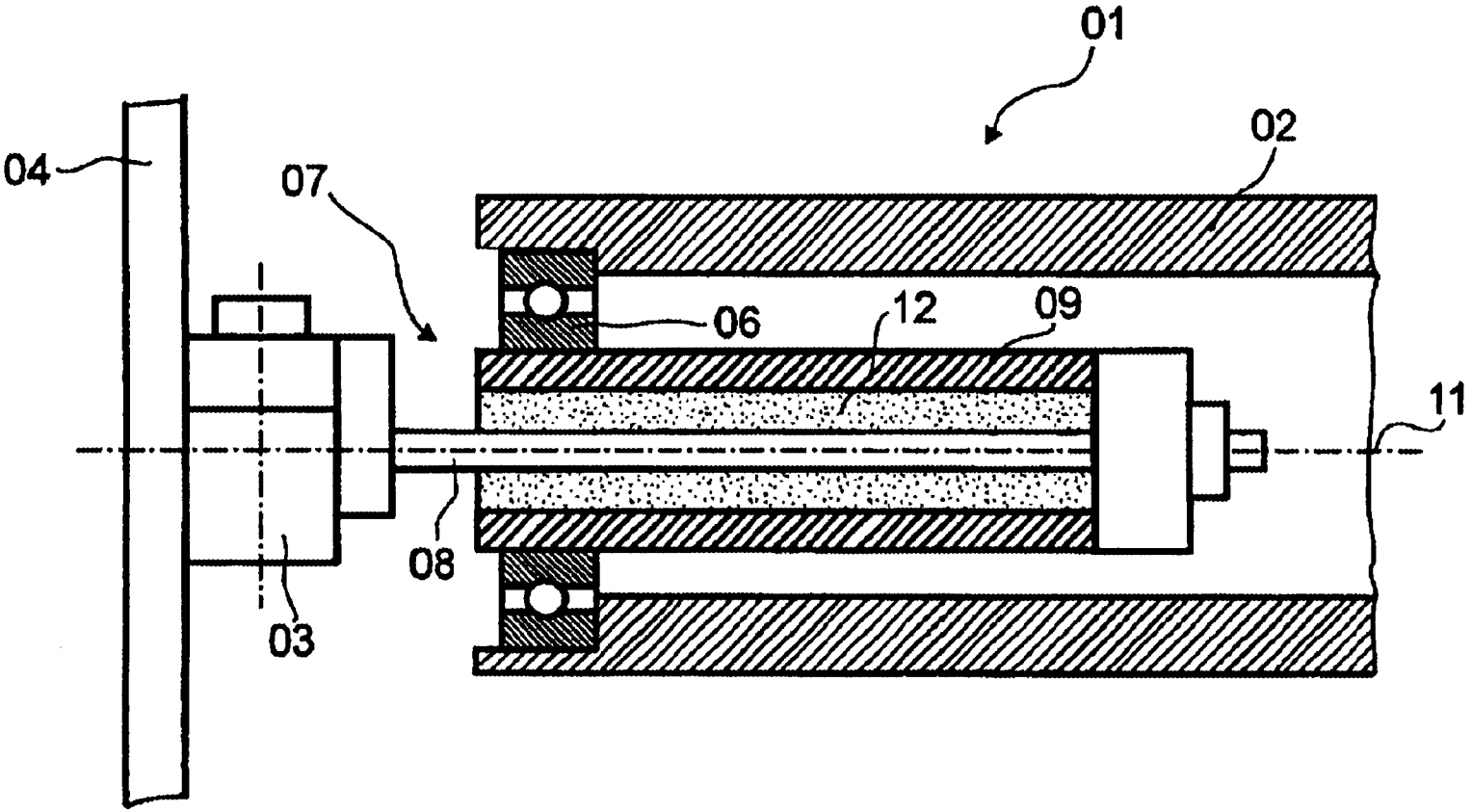
FIG. 1, a roller in accordance with the present invention and with its cross section partially represented, in FIG. 2, a schematic side view of a roller frame with five rollers, and in FIG. 3, a schematic side view of a roller frame with three rollers.

Referring initially to FIG. 1, there may be seen, generally at 01, a roller in accordance with the present invention. The roller 01, which is partially represented in FIG. 1, has a rotatably seated roller body 02, whose outer circumferential surface can be placed against a counter-pressure roller, which is not specifically represented in FIG. 1. The roller 01 is fastened on a press frame 04 of a printing press by the use of a bearing element 03. The roller 01, which may be, for example an application roller, can also be seated in levers for engagement and disengagement with the counter-pressure roller. In this connection, the bearing element 03 can be displaced by remote control for accomplishing a movement of the roller 01 in relation to the press frame 04, or to change the contact pressure between the roller 01 and the counter-pressure roller which is not specifically shown.

The roller body 02 is rotatably seated on shafts 07, only one of which is shown in FIG. 1, by the use of two bearings 06, for example two rolling bearings 06, each of which is arranged in the area of an end face of the roller body 02. Alternatively to the preferred embodiment represented in FIG. 1, it is, of course, also within the scope of the present invention to provide rolling bearings 06 in the bearing element 03 for the rotatable seating of the rolling body 02, in order to permit rotatory relative movements between each shaft 07 and the associated bearing element 03.

Each shaft 07 is embodied as a spring element, for example as a bar spring. This is constructively accomplished in that the shaft 07 has a spring element 08, for example a bar spring element 08, which can be elastically deformed transversely to its longitudinal axis 11. The bar spring element 08 is rigidly clamped to the bearing element 03 at a first end, and its second, opposite end is rigidly fastened on the end face of a sleeve 09. If a force acts on the roller body 02 radially in respect to the longitudinal axis 11 of the roller 01, the bar spring element 08 is at least slightly elastically deformed by this force, so that a spring force is created, which spring force is directed opposite to the force acting on the roller body 02.

The spring element 08 can also be embodied as a hollow spring element 08 in order to make possible the inlet and outlet of a cooling medium-conducting roller body 02.

The flexural strength of the bar spring element 08 has been selected to be such that a defined force is generated largely independently of its bending.

A damping element 12 is provided in a gap between the sleeve 09 and the bar spring element 08. This is constructively achieved in that the gap between the sleeve 09 and the bar spring element 08 is filled with a suitable oscillation-damping material.

The bar spring element 08, as depicted in FIG. 1, has a cross section in the shape of a circle so that, in the situation of the placement of the roller body 02 against two counter-pressure rollers, the same characteristic spring curve results in both placement directions. If the roller 01 is set with the correct flattening against a counter-pressure roller by the use of generally known engagement devices, this setting is also maintained with a constant force by the bar spring element 08 even under dynamic stresses. Occurring oscillations are kept below a tolerably threshold by use of the damping element 12.

Figure 2:
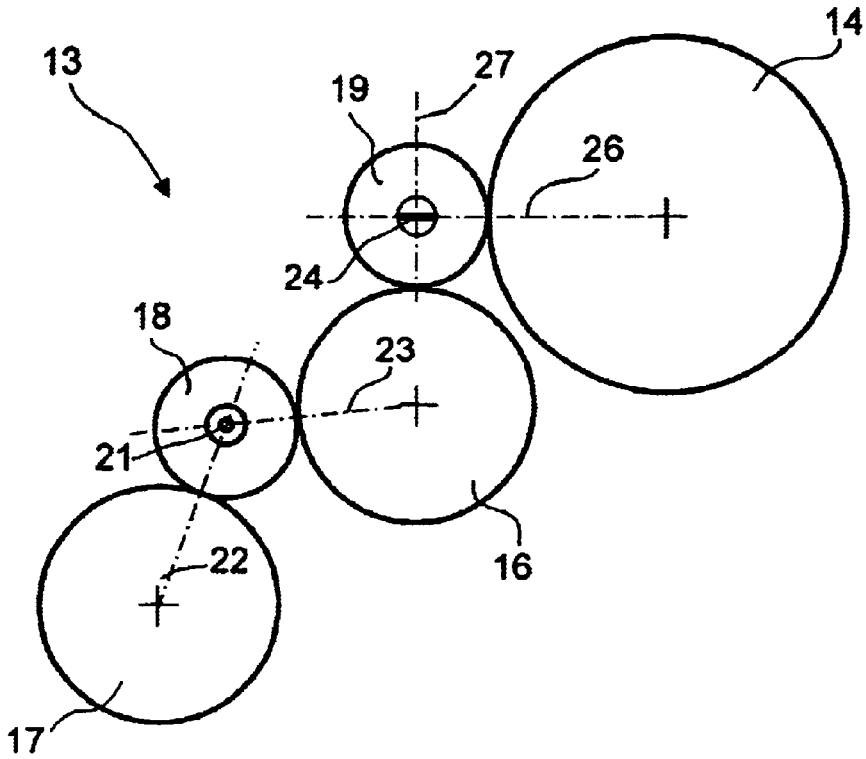

FIG. 2 shows an inking unit 13 for use with a plate cylinder 14, and including two distribution cylinders 16 and 17, a first roller 18, for example an inking roller 18, and a second roller 19, for example an application roller 19. Starting at the distribution cylinder 17, ink is transferred to the plate cylinder 14 via the inking roller 18, the distribution cylinder 16 and the application roller 19. The shaft of the inking roller 18 has a spring element 21 with a cross-section in the shape of a circle, for example a bar spring element 21, so that the characteristic spring curve of the inking roller 18, when placed against the distribution cylinders 16 and 17, is approximately the same in both engagement directions 22 and 23.

In contrast to the shaft spring element 21 of the first, inking roller 18, the shaft of the second, application roller 19 has a spring element 24, with a rectangular cross-sectional shape, for example a bar spring element 24. Because of the rectangular cross-sectional shape of the bar spring element 24 and because of its correspondingly suitable mounting arrangement, it is achieved that, when application roller 19 is placed against the plate cylinder 14 in the engagement direction 26, the bar spring element 24 makes possible a substantially rigid seating of the roller 19 against the cylinder 14 with a very steep characteristic spring curve. In other words, this means that the application roller 19 can only be displaced in the engagement direction 26 by correspondingly large forces. To set the flattening force of the application roller 19 against the plate cylinder 14, it is necessary for the bearing element 03 to be embodied so as to be displaceable in the engagement direction 26. In that case, the bar spring element 21 can again be twisted in the engagement direction 26 for fine adjustment. When the application roller 19 is placed against the distribution cylinder 16 in the engagement direction 27, the application roller 19 is relatively easily resiliently compressed, since in this direction the bar spring element 24 has its narrowest width.

In the situation of an asymmetric spring element, the spring element can be embodied to be rotatable, so that the contact pressure, viewed from the basic setting, can be increased, as well as reduced. In this case, the bearing element 03 is embodied in such a way that the spring element can be clamped.

Figure 3:
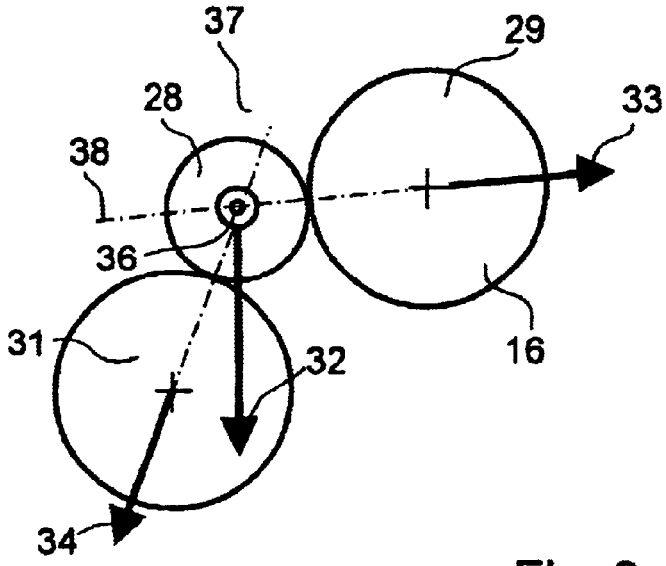
Figure 4:
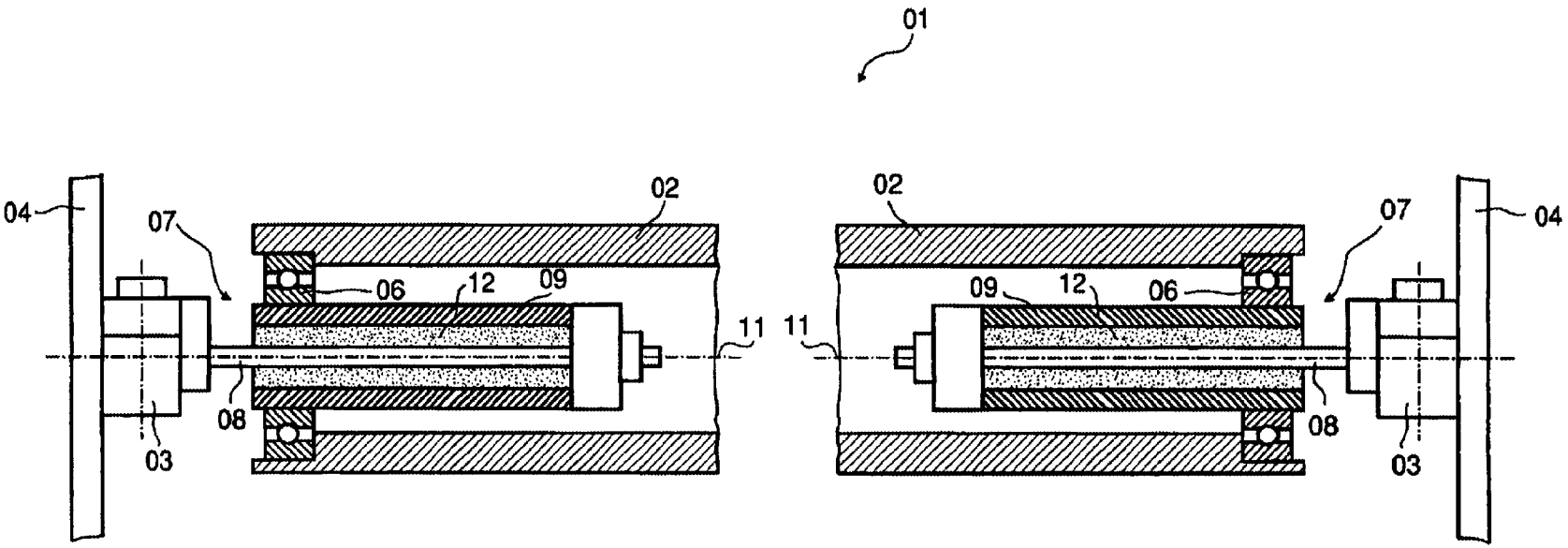
FIG. 4, a roller with first and second shafts engaging its end faces and supporting the roller body with a spring element in each of the first and second shafts.

A roller combination, including a roller 28 which is placed against two rollers 29 and 31, for example two counter-pressure rollers 29 and 31, is represented in FIG. 3. Since the counter-pressure roller 31 is arranged below the roller 28, a force of weight 32 caused by the weight of the roller 28 acts on the counter-pressure roller 31. So that, as the end result following the installation of the roller 28, the same engagement forces 33 and 34 act on the counter-pressure rollers 29 and 31, the roller 28, whose shaft has a spring element 36, for example a bar spring element 36, is mounted in such a way that the bar spring element 36 is differently pre-stressed along the engagement directions 37 and 38. It is possible, by a suitable selection of the difference between the pre-stresses along the engagement directions 37 and 38, to compensate for the force of the roller weight 32 acting on the counter-pressure roller 31, so that as a result the engagement forces 33, or 34, agree, as desired, in their amounts. By an appropriate selection of the pre-stress, it is, of course, also possible to set a different ratio of the various forces acting between the rollers 28, 29, 31.

The shaft 07 and the roller body 02 may be connected with each other, for example, so they cannot rotate in respect to each other. In another embodiment, the roller body 02 may rotate in relation to the shaft 07.

The spring element 08 typically has a flat characteristic spring curve.

The force generated by the spring element, for example an engagement force against a counter-pressure roller and/or counter-pressure cylinder, is almost independent of bending. For example, the force change is less than 50% in the area of the bending which occurs.

While preferred embodiments of a roller, in accordance with the present invention, have been st forth fully and completely hereinabove, it will be apparent to one of skill in the art that various changes in, for example, the overall size of the roller, the specific material utilized for the roller body and for the oscillation dampening material, and the like could be made without departing from the true spirit and scope of the present invention, which is accordingly to be limited only by the appended claims.

What is claimed:

1. A roller of a printing press comprising:

a roller body supported for rotation with respect to a frame of the printing press;

at least one shaft supporting said roller body; and at least one spring element arranged between said roller body and the press frame, said at least one shaft including said at least one spring element, said at least one spring element having a cross-section which is rotationally asymmetric, said cross-section being selected in accordance with a predetermined directionally-dependant spring characteristic.

2. The roller of claim 1 further including at least one distribution cylinder and at least one counter-pressure roller in contact with said roller.

3. The roller of claim 1 further including a second shaft also supporting said roller body, said one shaft and said second shaft both extending along a longitudinal axis of said roller, said one shaft and said second shaft engaging opposing end faces of said roller.

4. The roller of claim 1 further including at least one additional roller in contact with said roller, said cross-section of said spring being selected also in accordance with a predetermined spring characteristic with respect to said additional roller.

5. The roller of claim 1 wherein said cross-section substantially allows no elastic deformation in at least one direction.

6. The roller of claim 4 wherein said cross-section substantially allows no elastic deformation in at least one direction.

7. The roller of claim 6 wherein said at least one additional roller includes a plate cylinder and a distribution cylinder, wherein said roller is an application roller and wherein said spring element cross-section is selected such that said application roller is seated substantially rigidly with respect to said plate cylinder.

8. The roller of claim 1 wherein said roller has a roller weight and further wherein said cross-section of said spring element is selected to compensate for reaction forces resulting from said roller weight when said roller is in contact with additional rollers.

9. The roller of claim 1 further including a dampening element interposed between said roller body and said at least one shaft.

10. The roller of claim 1 further including an adjustable bearing element secured to said frame and receiving an end of said at least one shaft.

11. The roller of claim 1 wherein said at least one spring is a bar spring.

12. The roller of claim 1 wherein said roller body and said at least one shaft are relatively rotatable.

13. The roller of claim 1 wherein said spring element has a flat characteristic curve.

14. The roller of claim 1 wherein said roller is an inking roller.

15. The roller of claim 1 wherein said roller body is supported for rotation with respect to said at least one spring element.

16. A roller of a printing press comprising:

a roller body supported for rotation with respect to a frame of the printing press;

at least one shaft supporting said roller body;

at least one spring element arranged between said roller body and the press frame; and a sleeve between said roller body and said at least one shaft, said sleeve having an end face within an interior portion of said roller body, said sleeve end face being connected to an end of said spring.

17. The roller of claim 16 further including a dampening element interposed between said sleeve and said spring.

18. A roller of a printing press comprising:

a roller body supported for rotation with respect to a frame of the printing press;

at least one shaft supporting said roller body; and at least one spring element arranged between said roller body and the frame of the printing press, said at least one spring element being at least partially a bar spring, said bar spring at least partially forming said shaft.

19. The roller of claim 18 wherein said roller body and said at least one shaft are relatively rotatable.

20. The roller of claim 18 wherein said spring element has a flat characteristic curve.

21. The roller of claim 18 wherein said roller is an inking roller.

22. A roller of a printing press comprising:

a roller body supported for rotation about a longitudinal axis of rotation with respect to a frame of the printing press, said roller body having spaced opposing end faces;

at least first and second shafts engaging said end faces and supporting said roller body, said first and second shafts extending along said roller body longitudinal axis and supporting said roller body; and at least one spring element arranged between said roller body and the press frame in each of said first and second shafts, each said spring element being a bar spring, each said spring element being fixed against rotation.

23. The roller of claim 22 wherein said roller body is rotatably supported with respect to said first and second shafts.

* * * * *